US011858035B2

(12) United States Patent
Lee et al.

(10) Patent No.: US 11,858,035 B2
(45) Date of Patent: Jan. 2, 2024

(54) ELECTROMAGNETIC VIBRATION STIRRING DEVICE OF SEMI-SOLID HIGH PRESSURE CASTING EQUIPMENT

(71) Applicant: HANJOOMETAL CO., LTD, Ulsan (KR)

(72) Inventors: Yong Jin Lee, Busan (KR); Jin Ha Park, Ulsan (KR); Seong Rak Park, Ulsan (KR); Joong Suk Roh, Busan (KR); Hee Jae Bang, Busan (KR)

(73) Assignee: HANJOOMETAL CO., LTD, Ulsan (KR)

( * ) Notice: Subject to any disclaimer, the term of this patent is extended or adjusted under 35 U.S.C. 154(b) by 0 days.

(21) Appl. No.: 18/115,674

(22) Filed: Feb. 28, 2023

(65) Prior Publication Data

US 2023/0201917 A1 Jun. 29, 2023

Related U.S. Application Data

(62) Division of application No. 17/595,959, filed as application No. PCT/KR2020/003579 on Mar. 16, 2020, now abandoned.

(30) Foreign Application Priority Data

May 31, 2019 (KR) ..... 10-2019-0064348

(51) Int. Cl.
*B22D 27/02* (2006.01)
*B22D 17/00* (2006.01)

(52) U.S. Cl.
CPC ..... *B22D 27/02* (2013.01); *B22D 17/007* (2013.01)

(58) Field of Classification Search
CPC ..... B22D 27/02; B22D 17/007
See application file for complete search history.

(56) References Cited

U.S. PATENT DOCUMENTS

2004/0055726 A1 3/2004 Hong
2005/0167073 A1 8/2005 Hong
(Continued)

FOREIGN PATENT DOCUMENTS

JP 08-001281 A 1/1996
JP 2004-322203 A 11/2004
(Continued)

OTHER PUBLICATIONS

International Search Report for PCT/KR2020/003579 dated Jun. 19, 2020 (PCT/ISA/210).
(Continued)

*Primary Examiner* — Keith Walker
*Assistant Examiner* — Jacky Yuen
(74) *Attorney, Agent, or Firm* — Sughrue Mion, PLLC

(57) ABSTRACT

Proposed is an electromagnetic vibration stirring device of semi-solid high pressure casting equipment. The electromagnetic vibration stirring device includes: a ring-shaped casing including an inner wall into which a sleeve is inserted and an outer wall spaced apart from the inner wall; and a magnetic field generating unit located between the inner wall and the outer wall of the casing, and including a plurality of electromagnets radially arranged at equal intervals around the sleeve in a circumferential direction of the sleeve, each of the electromagnets including a core and a coil surrounding the core. The magnetic field generating unit generates a magnetic field by applying a current to the electromagnets in a clockwise or counterclockwise direction, and each portion of a semi-solid molten metal is sequentially vibrated by the magnetic field along the circumferential direction of the sleeve, thereby controlling a microstructure of the molten metal.

6 Claims, 11 Drawing Sheets

(56) References Cited

U.S. PATENT DOCUMENTS

| | | | |
|---|---|---|---|
| 2014/0083250 | A1 | 3/2014 | Akers |
| 2022/0241853 | A1 | 8/2022 | Lee |

FOREIGN PATENT DOCUMENTS

| | | | |
|---|---|---|---|
| KR | 10-2000-0041679 | A | 7/2000 |
| KR | 10-2003-0016869 | A | 3/2003 |
| KR | 10-0419757 | B1 | 2/2004 |
| KR | 10-2005-0004712 | A | 1/2005 |
| KR | 10-1187428 | B1 | 10/2012 |
| KR | 10-1253605 | B1 | 4/2013 |

OTHER PUBLICATIONS

Machine Translation of Kim (KR 10-2005-0004712 A, Jan. 12, 2005, cited in IDS filed Nov. 30, 2021). (Year: 2005).
Notice of Allowance issued from Korean Patent Application No. 10-2019-0064348 dated Feb. 19, 2021.
Office Action issued from Korean Patent Application No. 10-2019-0064348 dated Aug. 14, 2020.

ELECTROMAGNETIC VIBRATION STIRRING DEVICE OF SEMI-SOLID HIGH PRESSURE CASTING EQUIPMENT

CROSS-REFERENCE TO RELATED APPLICATIONS

This application is a Rule 53(b) Divisional of U.S. application Ser. No. 17/595,959 filed Nov. 30, 2021, which is a National Stage of International Application No. PCT/KR2020/003579 filed Mar. 16, 2020, claiming priority based on Korean Patent Application No. 10-2019-0064348 filed May 31, 2019, the entire disclosures thereof are incorporated herein by reference.

TECHNICAL FIELD

The present disclosure relates to an electromagnetic vibration stirring device of semi-solid high pressure casting equipment and, more particularly, to an electromagnetic vibration stirring device of semi-solid high pressure casting equipment, the electromagnetic vibration stirring device being capable of controlling the structure of a semi-solid molten metal by applying electromagnetic vibration to the semi-solid molten metal.

BACKGROUND ART

Rheocasting is a process of producing a billet or a molded product from a semi-solid metal having a predetermined viscosity through casting or forging. The semi-solid metal is in a state in which a liquid phase and spherical solid particles coexist in an appropriate ratio in a semi-solid temperature range. Therefore, the semi-solid metal can change its shape even by a small force due to its thixotropic properties and can be easily cast like a liquid due to its high fluidity.

Semi-solid metals generally have fluidity at a lower temperature than molten metal, so that the temperature of a casting device can be lowered compared to the molten metal, thereby ensuring a prolonged lifespan of the device. In addition, when a semi-solid metal is extruded, turbulence is less likely to occur compared to a liquid state, so that the amount of air introduced during casting can be reduced. Furthermore, the use of semi-solid metals leads to reduced solidification shrinkage, improved workability, and lightweight products. Therefore, the semi-solid metals can be used in the field of advanced material forming technology, for example, in the field of materials for major lightweight aluminum parts of vehicles.

High pressure casting, which is one of the casting processes that can use semi-solid metals as casting materials, refers to a process in which a molten metal is forced into a mold, which has a hollow cavity of predetermined shape, and pressurized until solidification. In some cases, the structure of the molten metal in a semi-solid state is controlled by generating an electromagnetic field inside the molten metal through electromagnetic stirring.

With regard to high pressure casting using an electromagnetic stirring means, a technique has been developed to find a generation pattern of an electromagnetic field and an optimum stirring condition of a molten metal. However, when a magnetic field of about 100 Gauss is generated in an electromagnet of the electromagnetic stirring means, a coil may be disconnected due to overheating. Also, an impact on upper and lower molds of a high pressure casting device may be delivered to the electromagnetic stirring means, causing an error in the operation of the electromagnetic stirring means. This may lead to a problem in magnetic field formation. In addition, as the molten metal in a sleeve is rotated by the magnetic field, turbulence may be generated inside the molten metal. This turbulence may cause air to be introduced into the molten metal, resulting in a deterioration of the quality of castings.

DISCLOSURE

Technical Problem

An objective of the present disclosure is to provide an electromagnetic vibrating stirring device of semi-solid high pressure casting equipment, the electromagnetic vibrating stirring device having a magnetic field generating unit capable of suppressing overheating of an electromagnet to prevent disconnection of a coil due to overheating.

Another objective of the present disclosure is to provide an electromagnetic vibrating stirring device of semi-solid high pressure casting equipment, the electromagnetic vibrating stirring device being capable of controlling the structure of a semi-solid molten metal by applying periodic vibrations to the semi-solid molten metal.

Still another objective of the present disclosure is to provide an electromagnetic vibrating stirring device of semi-solid high pressure casting equipment, the electromagnetic vibrating stirring device having a magnetic field generating unit at a lower end or lower portion of a lower mold of the semi-solid high pressure casting equipment so that the magnetic field generating unit is protected against an impact on the mold.

The objectives of the present disclosure are not limited to the above-mentioned objectives, and other objectives not mentioned will be clearly understood by those skilled in the art to which the present disclosure belongs from the following description.

Technical Solution

In order to accomplish the above objectives, the present disclosure provides an electromagnetic vibration stirring device of semi-solid high pressure casting equipment, the electromagnetic vibration stirring device including: a ring-shaped casing including an inner wall into which a sleeve is inserted and an outer wall spaced apart from the inner wall; and a magnetic field generating unit located between the inner wall and the outer wall of the casing, and including a plurality of electromagnets radially arranged at equal intervals around the sleeve in a circumferential direction of the sleeve, each of the electromagnets including a core and a coil surrounding the core. The magnetic field generating unit may generate a magnetic field by applying a current to the electromagnets in a clockwise or counterclockwise direction, and each portion of a semi-solid molten metal may be sequentially vibrated by the magnetic field along the circumferential direction of the sleeve, thereby controlling a microstructure of the molten metal.

The magnetic field generating unit may generate the magnetic field by applying the current to a pair of opposed electromagnets or a pair of non-adjacent electromagnets in the clockwise or counterclockwise direction.

The electromagnets of the magnetic field generating unit may be arranged such that the respective cores of the electromagnets are located perpendicular to a central axis of the sleeve.

The magnetic field generating unit may include a cooling channel formed in the coil of each of the electromagnets.

The magnetic field generating unit may generate a magnetic field of 500 to 1000 Gauss in a center region of the sleeve.

The respective cores of the electromagnets may be radially arranged at equal intervals of 60 degree angles on an inner surface of the outer wall of the casing, and the respective coils of the electromagnets may be coupled to the respective cores by insertion fitting.

The sleeve may be made of HK40 steel or ceramic.

The electromagnetic vibration stirring device may be located at a lower end or lower portion of a lower mold of the semi-solid high pressure casting equipment and may be coupled to a lower portion of the sleeve.

Advantageous Effects

An electromagnetic vibration stirring device of semi-solid high pressure casting equipment according to the present disclosure has an advantage of suppressing overheating of an electromagnet through a cooling channel provided inside a coil of each electromagnet, thereby preventing disconnection of the coil due to overheating.

Another advantage is that it is possible to control the structure of a semi-solid molten metal by applying periodic vibrations to the semi-solid molten metal, thereby preventing formation of dendrites or destroying the dendrites. Still another advantage is that a magnetic field generating unit is located at a lower end or lower portion of a lower mold of the semi-solid high pressure casting equipment so that the magnetic field generating unit can be protected against an impact on the mold.

BEST MODE

Figure 1:
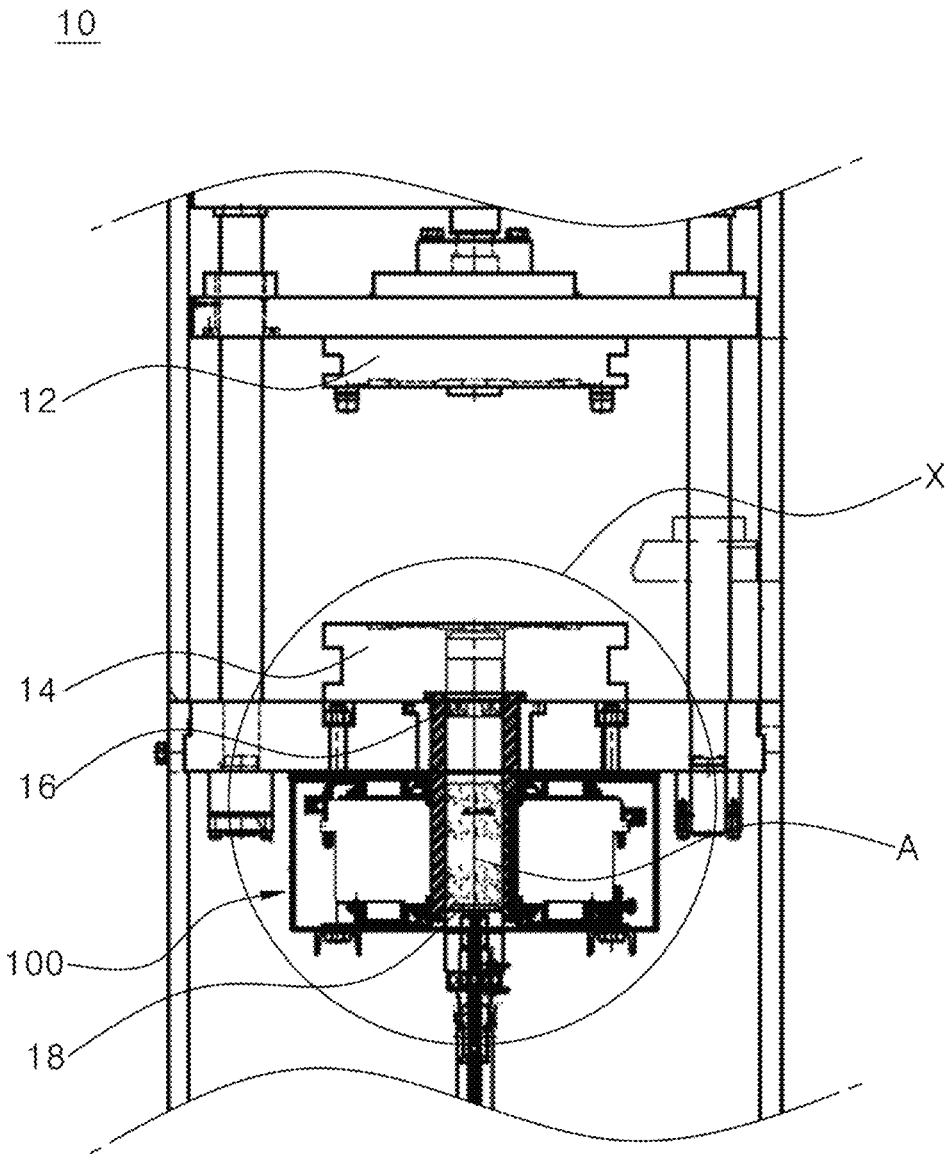
FIG. 1 is a sectional view illustrating a semi-solid high pressure casting equipment having an electromagnetic vibration stirring device according to an embodiment of the present disclosure.

Hereinafter, exemplary embodiments of the present disclosure will be described in detail with reference to the accompanying drawings. The embodiments are provided as example for those skilled in the art to be able to more clearly understand the spirit of the present disclosure. Accordingly, the present disclosure is not limited to the embodiments and may be achieved in other ways. Also, in the drawings, lengths, thicknesses, etc. of layers and regions may be exaggerated for convenient description. Throughout the drawings, the same reference numerals will refer to the same or like parts.

Figure 2:
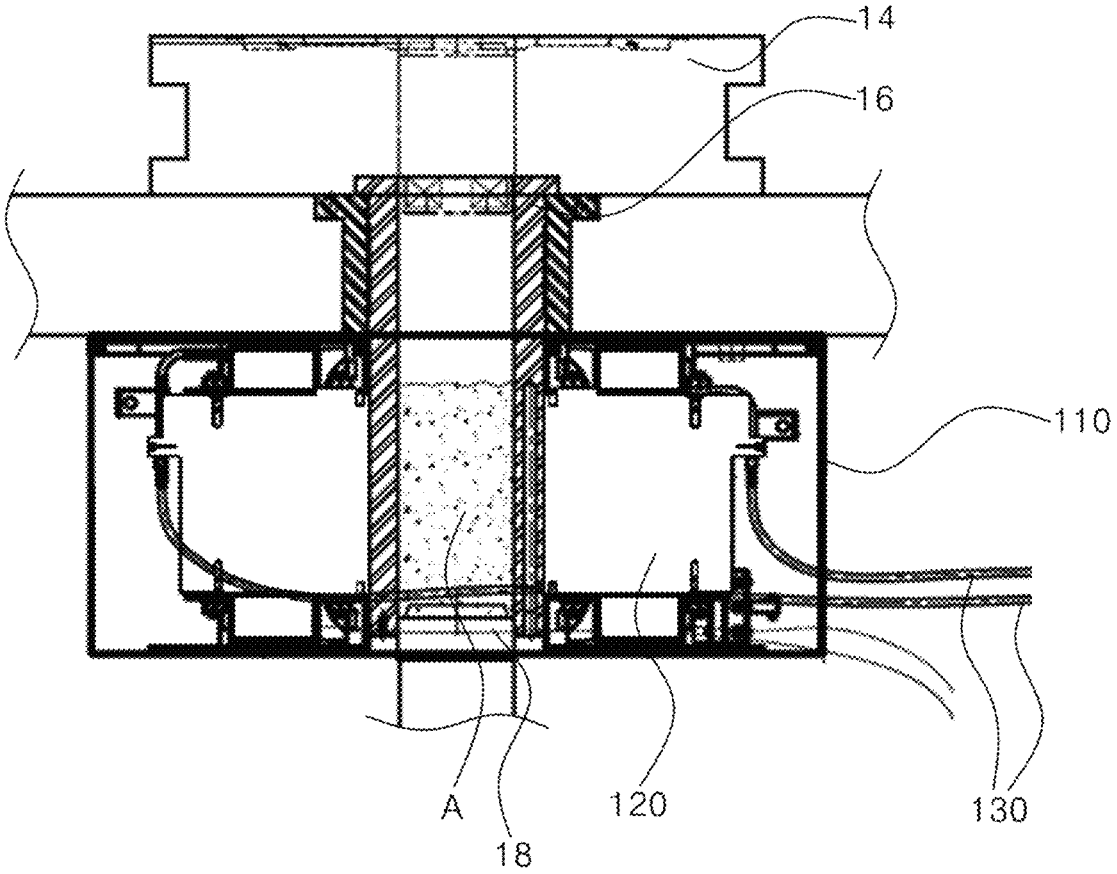
FIG. 2 is an enlarged view of the section X of FIG. 1.
Figure 3:
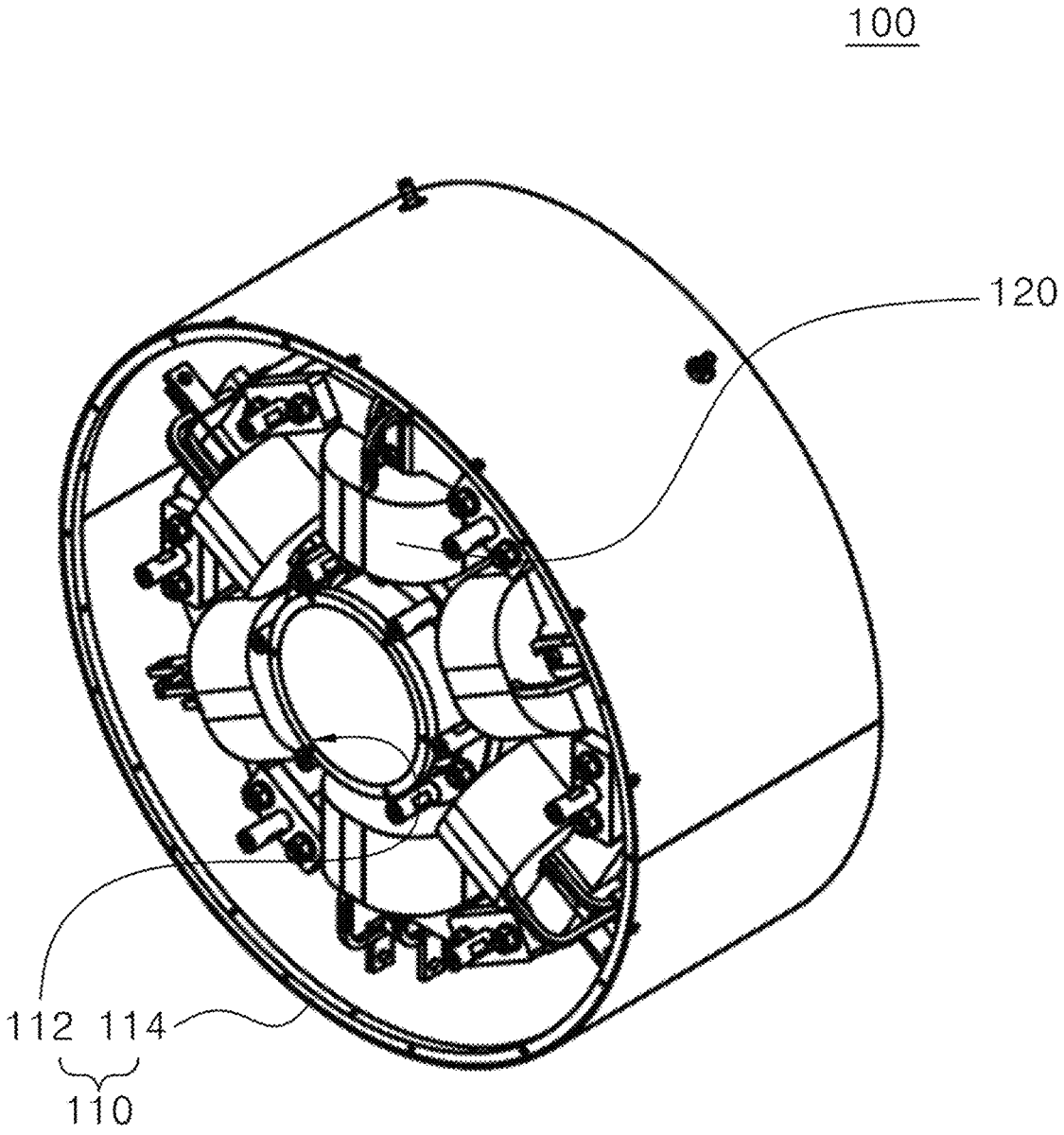
FIG. 3 is a perspective view illustrating the electromagnetic vibration stirring device of the semi-solid high pressure casting equipment according to the embodiment of the present disclosure.
Figure 4:
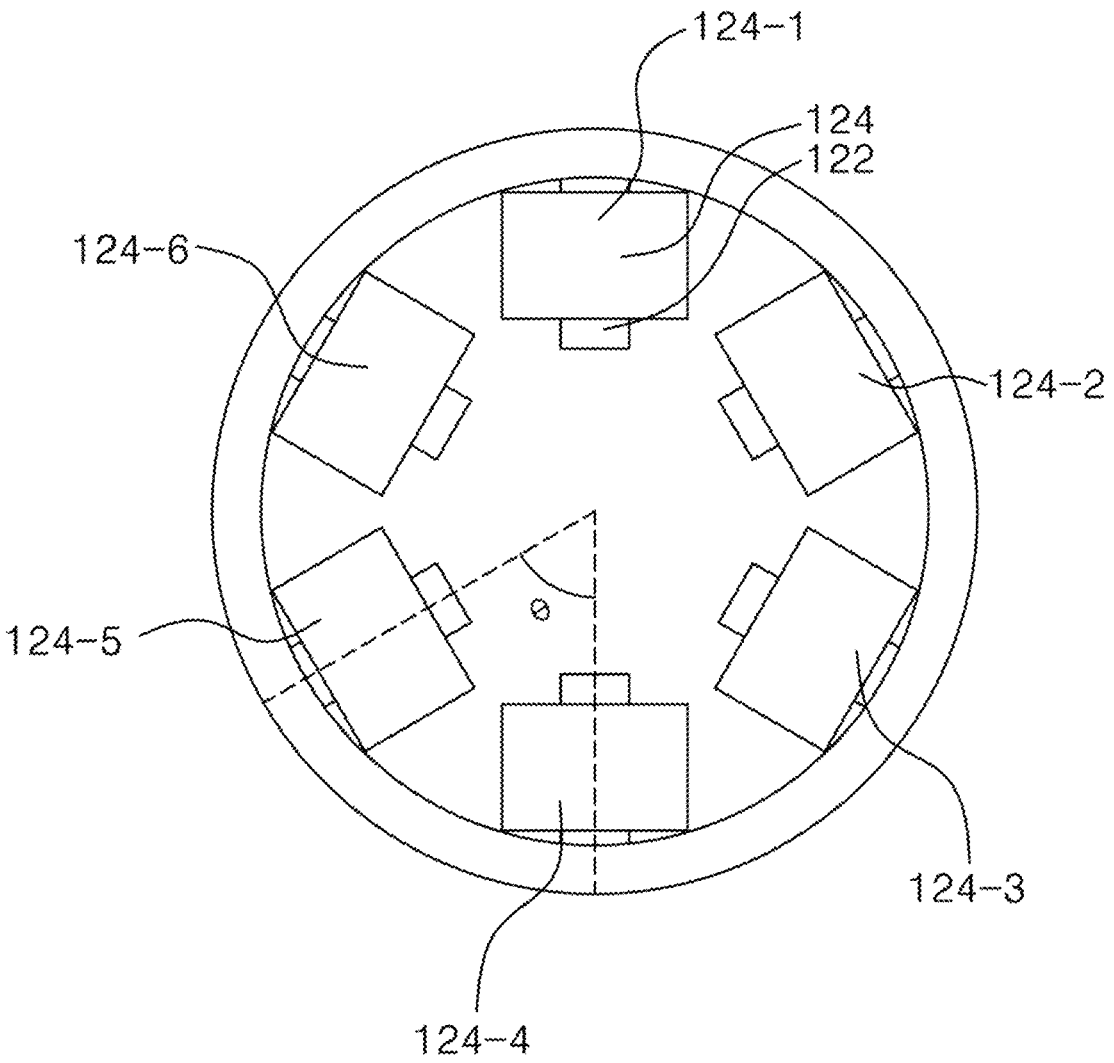
FIG. 4 is a perspective view illustrating a magnetic field generating unit illustrated in FIG. 3.
Figure 5:
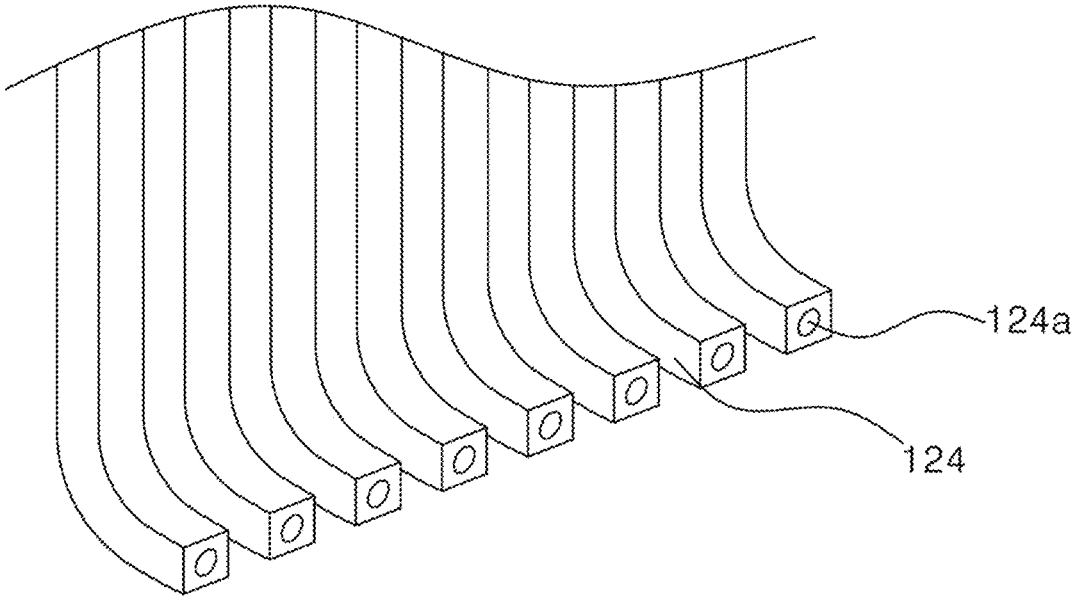
FIG. 5 is a perspective view illustrating a section of an electromagnet coil of the magnetic field generating unit according to the embodiment of the present disclosure.
Figure 6:
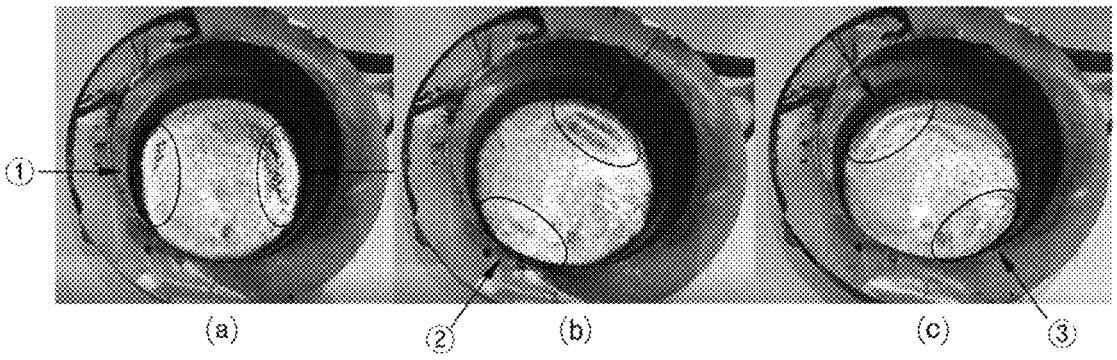
FIG. 6 illustrates images illustrating a molten metal to which a magnetic field has been applied using the electromagnetic vibration stirring device of the semi-solid high pressure casting equipment according to the embodiment of the present disclosure.

FIG. 1 is a sectional view illustrating a semi-solid high pressure casting equipment having an electromagnetic vibration stirring device according to an embodiment of the present disclosure; FIG. 2 is an enlarged view of the section X of FIG. 1; FIG. 3 is a perspective view illustrating the electromagnetic vibration stirring device of the semi-solid high pressure casting equipment according to the embodiment of the present disclosure; FIG. 4 is a perspective view illustrating a magnetic field generating unit illustrated in FIG. 3; FIG. 5 is a perspective view illustrating a section of an electromagnet coil of the magnetic field generating unit according to the embodiment of the present disclosure; and FIG. 6 illustrates images illustrating a molten metal to which a magnetic field has been applied using the electromagnetic vibration stirring device of the semi-solid high pressure casting equipment according to the embodiment of the present disclosure.

Referring to FIGS. 1 to 6, the semi-solid high pressure casting equipment 10 includes an upper mold 12, a lower mold 14, a sleeve 16 for injecting a molten metal A into the molds, and a plunger 18.

After the molten metal A is injected into the sleeve 16 having a cylindrical hollow portion, the plunger 18 pressurizes the molten metal A injected into the sleeve 16 while moving inside the sleeve 16, causing the molten metal A to be forced into the mold. The molten metal A forced into a molding region between the upper mold 12 and the lower mold 14 is allowed to solidify for a predetermined period of time, and the casting operation is completed to produce a casting.

The electromagnetic vibration stirring device 100 of the semi-solid high pressure casting equipment 10 according to the embodiment of the present disclosure is coupled to an outer peripheral surface of the sleeve 16 and is configured to control the structure of a semi-solid molten metal A by applying electromagnetic vibration to the molten metal A to suppress the generation of dendrites.

In detail, the electromagnetic vibration stirring device 100 includes a casing 110 and the magnetic field generating unit 120. The casing 110 has a ring shape and includes an inner wall 112 into which the sleeve is inserted and an outer wall 114 spaced apart from the inner wall 112. In addition, to protect the magnetic field generating unit 120 located inside the casing 110 from outside, the casing 110 has a structure in which both upper and lower portions of the region between the inner wall 112 and the outer wall 114 are sealed.

The casing 110 is made of a non-magnetic material so as not to interfere with a magnetic field generated by the magnetic field generating unit 120.

The magnetic field generating unit 120 is located between the inner wall 112 and the outer wall 114 of the casing 110, and includes a plurality of electromagnets 120 radially arranged at equal intervals around the sleeve 16 in a circumferential direction of the sleeve 16, each electromagnet 120 including a core 122 and a coil 124 surrounding the core 122. The magnetic field generating unit 120 generates a magnetic field by applying a current to the electromagnets 120 in a clockwise or counterclockwise direction. The magnetic field causes each portion of the semi-solid molten metal A to be sequentially vibrated by the magnetic field along the circumferential direction of the sleeve 16. When the magnetic flux of the magnetic field generated by the magnetic field generating unit 120 applies an impact to the inside of the molten metal A, a portion of the molten metal A is vibrated in a vertical direction, so that intermittent vibrational stirring in the vertical direction is achieved rather than rotational stirring. Therefore, without a rotational flow accompanied by turbulence with the semi-solid molten metal A, a vibrational flow accompanied by vibration of the molten metal A is generated, so that the microstructure of the semi-solid molten metal A is controlled by intermittent vibration of the molten metal A caused by the magnetic field impact. This prevents external air that may be introduced during rotational stirring by an electromagnetic field.

The magnetic field generating unit 120 generates a magnetic field by applying a current to a pair of opposed electromagnets or a pair of non-adjacent electromagnets in the clockwise or counterclockwise direction.

In detail, the magnetic field generating unit 120 generates a magnetic field sequentially in the circumferential direction by each pair of opposed electromagnets or each pair of non-adjacent electromagnets. For example, a pair of electromagnets 124-1 and 124-4, a pair of electromagnets 124-2 and 124-5, and a pair of electromagnets 124-3 and 124-6 generate respective magnetic fields by sequentially receiving a current in the counterclockwise direction. Alternatively, a pair of electromagnets 124-1 and 124-3, a pair of electromagnets 124-2 and 124-4, and a pair of electromagnets 124-3 and 124-5 generate respective magnetic fields by sequentially receiving a current in the counterclockwise direction.

Therefore, the structure of the semi-solid molten metal A in the sleeve 16 is controlled by periodically applying vibration to the molten metal A. In other words, by applying a current to each pair of opposed electromagnets of the magnetic field generating unit 120 in accordance with the sequence of (a), (b), and (c) of FIG. 6, each magnetic field is sequentially generated around the semi-solid molten metal A. When a current is applied to a pair of opposed electromagnets located as illustrated in (a) for a predetermined period of time, the molten metal A is subjected to an impact of the generated magnetic field and vibrated as indicated by the arrows ①. When a current is then applied to a pair of opposed electromagnets located as illustrated in (b) for a predetermined period of time, the molten metal A is subjected to an impact of the generated magnetic field and vibrated as indicated by the arrows ②. In other words, as the magnetic flux of the magnetic field applies an impact to the inside of the molten metal A as indicated by the arrows ①, ② and ③, a portion of the molten metal A is stirred as it is vibrated, rather than rotated, intermittently and periodically in the vertical direction. In addition, as each magnetic field is sequentially applied along the circumferential direction of the sleeve 16 in the clockwise or counterclockwise direction, the molten metal A in the sleeve 16 is periodically vibrated and stirred more uniformly, so that the microstructure of the molten metal A is controlled.

Furthermore, when a current is applied to the opposed electromagnets or the non-adjacent electromagnets for less than 0.5 seconds, rotational stirring may occur. To prevent the occurrence of this rotational stirring, it is preferable that a magnetic field is generated by applying a current for equal to or more than 0.5 seconds. In this case, it is preferable that one cycle has a time period of less than 20 seconds to efficiently apply a uniform magnetic force to the entire molten metal A.

As described above, in the case of the casting method based on simultaneous application to the opposed or non-adjacent electromagnets of the plurality of electromagnets, a vibrational flow accompanied by vibration of the semi-solid molten metal A is achieved even when a magnetic field is generated, without a rotational flow accompanied by turbulence within the molten metal A. Therefore, the microstructure of the molten metal A is controlled by the vibration of the molten metal A caused by the magnetic field impact, thereby preventing external air that may be introduced during rotational stirring by the electromagnetic field. In addition, the amount of air contained in a billet is minimized and the generation and dispersion of nuclei are promoted, so that dendrite structures are refined and spheroidized, thereby minimizing the formation of internal voids. As a result, it is possible to produce a casting with a more stable quality compared to conventional microstructure control based on rotation.

Similar to the casting method based on simultaneous application to the opposed or non-adjacent electromagnets of the plurality of electromagnets, a current is periodically applied to three electromagnets 124-1, 124-3, and 124-5, a vibratory stirring effect may also be achieved.

The electromagnets of the magnetic field generating unit 120 are arranged such that the respective cores 122 of the electromagnets are located perpendicular to the central axis of the sleeve 16. In this case, the magnetic flux of the magnetic field generated by the magnetic field generating unit 120 and the sleeve 16 are located perpendicular to each other. Therefore, as an impact is applied to the molten metal A in the direction of the magnetic flux as illustrated in FIG. 6, the molten metal A is vibrated and the microstructure thereof is controlled thereby.

The magnetic field generating unit 120 includes a cooling channel **124*a* formed in the coil 124 of each of the electromagnets. Therefore, cooling oil or cooling water flows directly along the inside of the coil 124, thereby reducing the heat generated by the coil 124 even in the presence of a large magnetic field of equal to or greater than 400 Gauss. As a result, a magnetic field is generated without disconnection of the coil 124, making it possible to continuously control the microstructure of the semi-solid molten metal A. The cooling channel 124*a* formed inside the coil 124 is connected to an external cooling channel 130 to continuously receive cooling oil or cooling water, and the cooling oil or cooling water heated by absorbing the heat of the coil 124 is discharged to outside through the external cooling channel 130**.

In addition, the magnetic field generating unit 120 generates a magnetic field of 500 to 1000 Gauss with respect to a center region of the sleeve 16 and applies a magnetic field impact to the molten metal A located in the sleeve 16 to control the microstructure.

The magnetic field generating unit 120 includes the cores 122 radially arranged at equal intervals of 60 degree angles 110 on an inner surface of the outer wall 114 of the casing 110. The respective coils 124 are coupled to the respective cores 122 by insertion fitting. Therefore, the coils 124 are detached and replaced at the end of their lifespan, thereby reducing equipment replacement costs. For insertion fitting, each of the plurality of electromagnets has an open structure.

The sleeve 16 is made of HK40 steel or ceramic. The sleeve 16 made of a non-magnetic material such as HK40 steel or ceramic hardly absorbs a magnetic field even when a strong magnetic field is generated by the magnetic field generating unit 120 and minimizes a reaction such as vibration of the sleeve 16. Therefore, in the case of the sleeve 16 made of a non-magnetic material, the microstructure of the molten metal A in the sleeve 16 is controlled, while the sleeve 16 does not interfere with the strength of the magnetic field generated by the magnetic field generating unit 120. As a result, it is possible to produce a high-quality casting.

As illustrated in the section X of FIG. 1, the electromagnetic vibration stirring device 100 of the semi-solid high pressure casting equipment 10 is located at a lower end or lower portion of the lower mold 14 of the semi-solid high pressure casting equipment 10 and is coupled to a lower portion of the sleeve 16. Therefore, the electromagnetic vibration stirring device 100 is little affected by an impact on the upper mold 12 and the lower mold 14 during the manufacture of the casting, thereby protecting the magnetic field generating unit 120 against the impact.

Hereinafter, the electromagnetic vibration stirring device of the semi-solid high pressure casting equipment according to the present disclosure will be described with reference to the following experimental examples. However, the following experimental examples are only illustrative and are not intended to limit the scope of the present disclosure.

Crucible Manufacturing And Magnetic Field Measurement Area Setting

Figure 7:
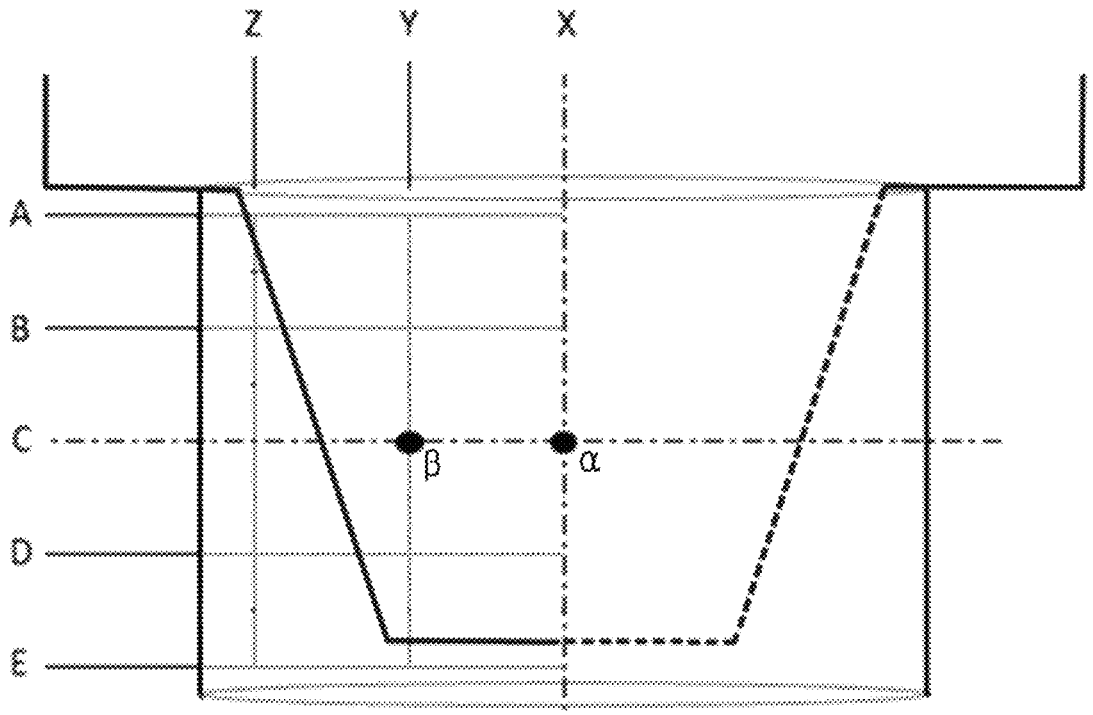
FIG. 7 is a sectional view illustrating a crucible for an experimental example of the present disclosure.

For a vibration stirring experiment for the electromagnetic vibration stirring device of the semi-solid high pressure casting equipment according to the present disclosure, a crucible was manufactured using SUS304. The crucible was manufactured to have an upper diameter of 120 mm, a lower diameter of 72.5 mm, and a height of 260 mm. To compare magnetic field intensities for respective positions on the crucible, as illustrated in FIG. 7, a vertical central axis of the crucible was set to X, a vertical axis passing through the crucible wall was set to Z (60 mm away from X), and a vertical axis at the 1/2 point between X and Z was set to Y. In addition, a horizontal central axis of the crucible was set to C, a horizontal axis passing through the top surface of the crucible was set to A, and a horizontal axis passing through the bottom surface of the crucible was set to E, a 1/2 horizontal axis between A and C was set to B (60 mm away upward from C), and a 1/2 horizontal axis between C and E was set to D (60 mm away downward from C). In addition, a central point where the horizontal central axis C and the vertical central axis X of the crucible meet was set to a, and a point where the horizontal central axis C and the vertical axis Y meet was set to β.

Experimental Example 1—Magnetic Field Strength As Function Of Position On Crucible According To Applied Magnetic Field To measure a magnetic field strength as a function of a position on the crucible, currents of 20 A, 40 A, 60 A, 80 A, and 120 A were applied to the magnetic field generating unit of the electromagnetic vibration stirring device according to the embodiment of the present disclosure.

After the magnetic field generating unit was placed on the outside of the crucible as illustrated in FIG. 7, each of the currents was simultaneously applied to opposed electromagnets for 0.5 second. At this time, the application of the current was repeated periodically in the clockwise direction every 0.5 seconds, and the magnetic field strength was measured at points where the vertical axes X, Y, and Z and the horizontal axes A, B, C, D, and E meet.

Experimental Example 2—Magnetic Field Strength 1 As Function Of Position On Crucible According To Magnetic Field Application Method In the same manner as in Experimental Example 1, a magnetic field was generated according to each current, after which a magnetic field strength as a function of a position on the crucible was measured. The measurement of the magnetic field strength was performed by applying each current to a pair of opposed electromagnets for 0.5 second and then to a next pair of opposed electromagnets located clockwise of the previous pair for 0.5 second.

Experimental Example 3—Magnetic Field Strength 2 As Function Of Position On Crucible According To Magnetic Field Application Method The same procedure was performed as in Experimental Example 2, except that each current was applied to a pair of non-adjacent electromagnets in the counter clockwise direction.

Experimental Example 4—Magnetic Field Strength 3 As Function Of Position On Crucible According To Magnetic Field Application Method The same procedure was performed as in Experimental Example 2, except that each current was applied to a pair of adjacent electromagnets in the counter clockwise direction.

Experimental Example 5—Magnetic Field Strength 4 As Function Of Position On Crucible According To Magnetic Field Application Method In the same manner as in Experimental Example 1, a magnetic field was generated according to each current, after which a magnetic field strength as a function of a position on the crucible was measured. The measurement of the magnetic field strength was performed by sequentially applying each current to individual electromagnets in the counter clockwise direction.

Experimental Example 6—Magnetic Field Strength 5 As Function Of Position On Crucible According To Magnetic Field Application Method In the same manner as in Experimental Example 1, a magnetic field was generated according to each current, after which a magnetic field strength as a function of a position on the crucible was measured. The measurement of the magnetic field strength was performed by randomly applying each current to individual electromagnets.

Experimental Example 7—Magnetic Field Strength In Presence Or Absence Of Sleeve

To compare magnetic field intensities in the presence or absence of the sleeve, each current was simultaneously applied to opposed electromagnets for 0.5 second both in the presence and in the absence of the sleeve made of HK40 steel. A magnetic field strength as a function of a position on the crucible was measured by periodically repeating the application of the current in the clockwise direction.

Experimental Example 8—Cooling rate of molten metal as function of strength of applied magnetic field After placing the molten metal in the electromagnetic vibration stirring device according to the embodiment of the present disclosure, currents of 40 A, 60 A, 80 A, and 120 A were applied to the magnetic field generating unit in such a manner that each of the currents was simultaneously applied to opposed electromagnets for 0.5 second in the clockwise direction. A change in temperature per minute of the molten metal at the points α and β of FIG. 7 was measured, and a deviation of a cooling rate of the molten metal was obtained.

Figure 8:
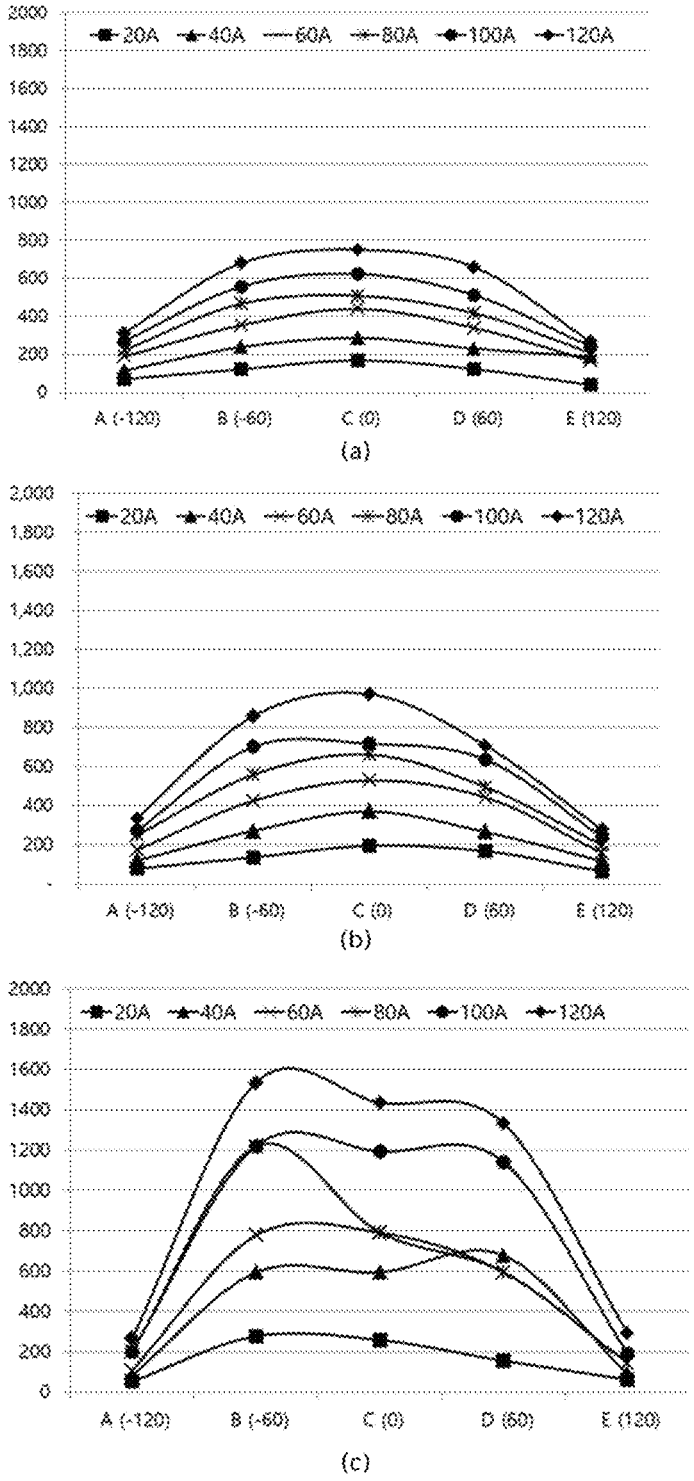
FIG. 8 illustrates graphs illustrating a magnetic field strength as a function of a vertical position on the crucible according to applied currents, in which the magnetic field strength is measured at a center region, a 1/4 region, and an edge region of the crucible illustrated in FIG. 7 in a plane.

Result 1—Magnetic Field Strength As Function Of Position On Crucible According To Applied Magnetic Field FIG. 8 illustrates graphs illustrating a magnetic field strength as a function of a vertical position on the crucible according to applied currents, in which the magnetic field strength is measured at a center region, a 1/4 region, and an edge region of the crucible illustrated in FIG. 7 in a plane. In FIG. 8, the results of Experimental Example 1 are illustrated.

Referring to FIG. 8, in the case of the center region of the crucible corresponding to the regions of the axes X and Y, as illustrated in (a) and (b), when the current strength was increased, i.e., when the strength of an applied magnetic field was increased, the magnetic field was increased in the regions of the axes B, C, and D inside the crucible. However, in the case of the crucible wall, as illustrated in (c), the strength of an applied magnetic field was larger than that of the regions of the axes X and Y, while the formation of the magnetic field is unstable as it goes from the center to the edge.

Figure 9:
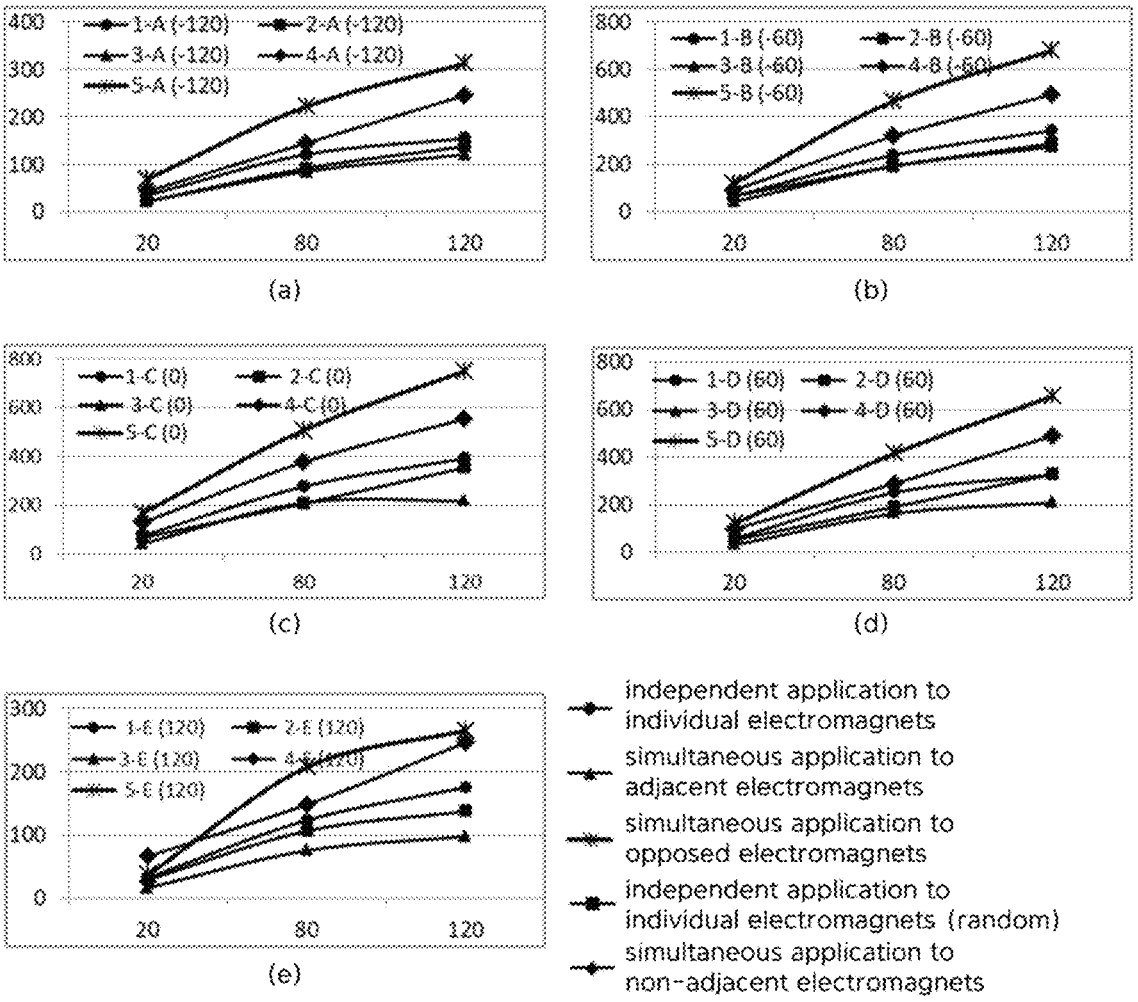
FIG. 9 illustrates graphs illustrating a change in the magnetic field strength as a function of the vertical position on the crucible according to an electromagnet application method, in which the magnetic field strength is measured at the center region of the crucible in the plane.
Figure 10:
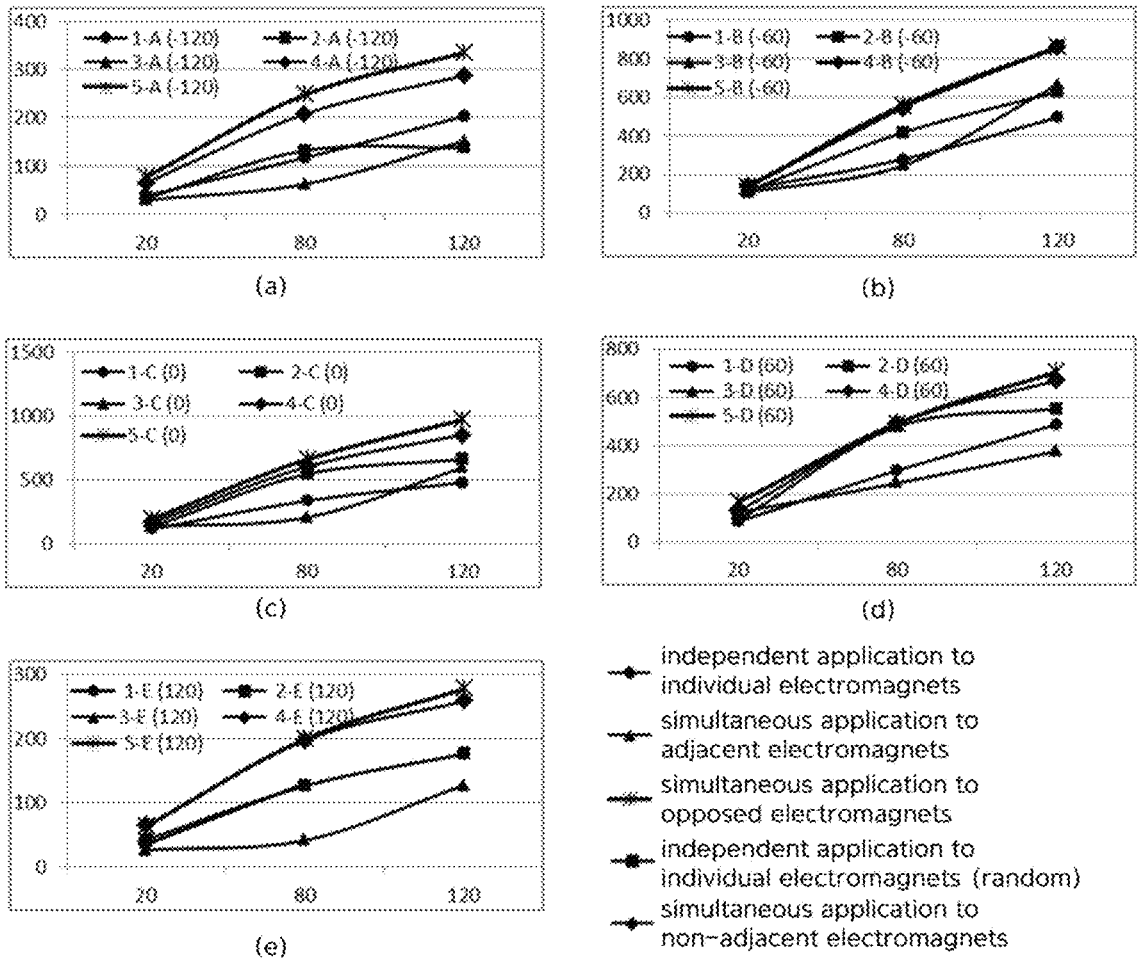
FIG. 10 illustrates graphs illustrating a change in the magnetic field strength as a function of the vertical position on the crucible according to the electromagnet application method, in which the magnetic field strength is measured at the 1/4 region of the crucible in the plane.
Figure 11:
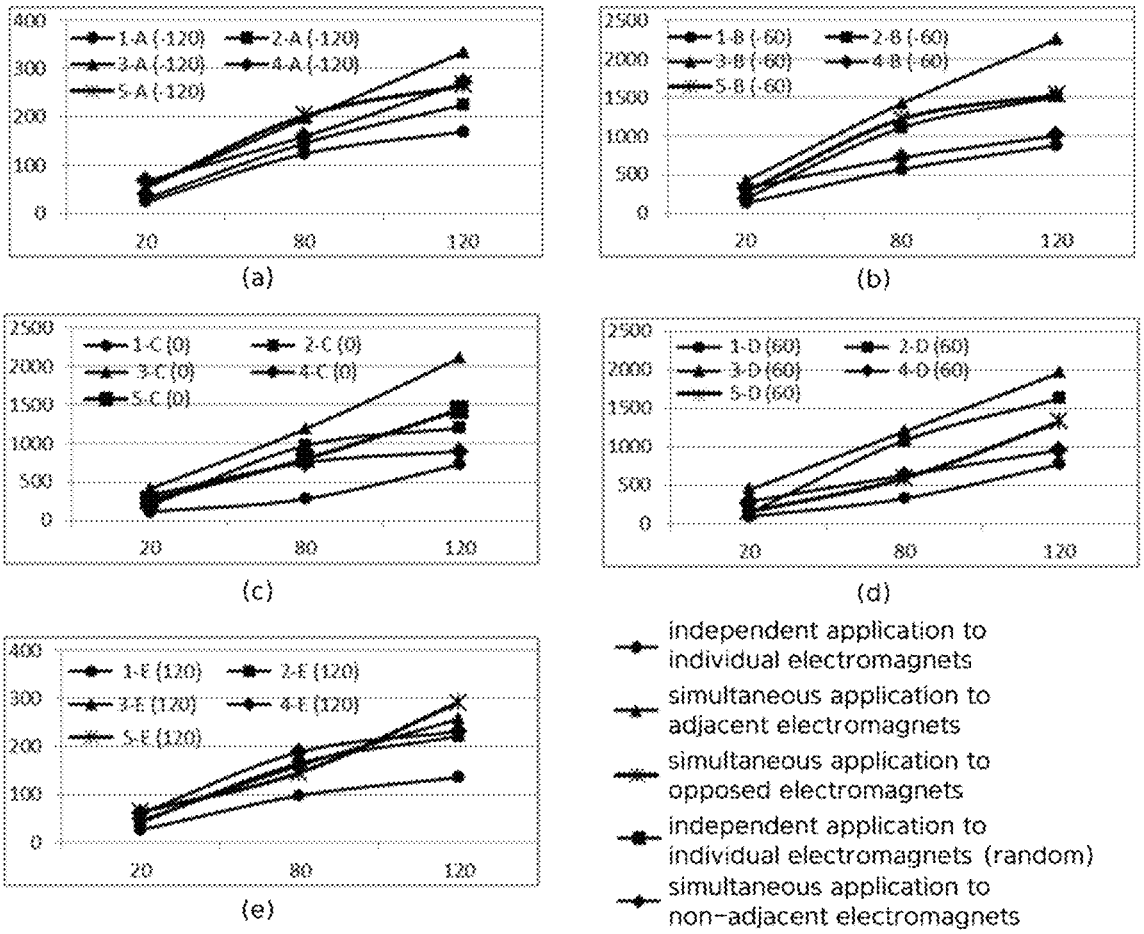
FIG. 11 illustrates graphs illustrating a change in the magnetic field strength as a function of the vertical position on the crucible according to the electromagnet application method, in which the magnetic field strength is measured at the edge region of the crucible in the plane.

Result 2—Magnetic Field Strength As Function Of Position On Crucible According To Magnetic Field Application Method FIG. 9 illustrates graphs illustrating a change in the magnetic field strength as a function of the vertical position on the crucible according to an electromagnet application method, in which the magnetic field strength is measured at the center region of the crucible in the plane; FIG. 10 illustrates graphs illustrating a change in the magnetic field strength as a function of the vertical position on the crucible according to the electromagnet application method, in which the magnetic field strength is measured at the 1/4 region of the crucible in the plane; FIG. 11 illustrates graphs illustrating a change in the magnetic field strength as a function of the vertical position on the crucible according to the electromagnet application method, in which the magnetic field strength is measured at the edge region of the crucible in the plane. In FIGS. 9, 10, and 11, the results of Experimental Examples 2 to 6 are illustrated. In each figure, (a), (b), (c), (d), and (e) illustrate the change in the magnetic field strength of the regions of the horizontal axes A, B, C, D, and E, respectively.

In the case of the vertical axes X and Y, a magnetic field in the case of simultaneous application to opposed electromagnets was the largest, and a magnetic field in the case of simultaneous application to non-adjacent electromagnets was the second largest. In addition, a magnetic field in the case of simultaneous application was larger than that in the case of independent application. In the case of simultaneous application to adjacent electromagnets, the magnetic field was canceled, indicating that the magnetic field was reduced compared to other simultaneous application methods. However, in the case of the vertical axis Z, i.e., the edge region, a magnetic field in the case of simultaneous application to adjacent electromagnets was the largest. This may indicate that the effect of an electric field due to the current in two adjacent cores and coils was stronger than that of the magnetic field due to the magnetic flux. In the vicinity of the two adjacent cores, electromagnetic forces generated from the cores are combined. Therefore, in the case of simultaneous application to adjacent electromagnets, a strongest electromagnetic force is generated at the edge region where electromagnetic forces generated from the adjacent electromagnets are combined to form a larger force, while a weakest electromagnetic force is generated at the center region and 1/4 regions.

Result 3—Magnetic Field Strength In Presence Or Absence Of Sleeve

The results of Experimental Example 7 are illustrated in Table 1 below.

TABLE 1

| Applied | | X | | | Y | | | Z | | |
|---|---|---|---|---|---|---|---|---|---|---|
| current (A) | | 40 | 80 | 120 | 40 | 80 | 120 | 40 | 80 | 120 |
| A | Absence | 114 | 222 | 313 | 118 | 248 | 335 | 114 | 220 | 324 |
| | Presence | 112 | 198 | 340 | 128 | 217 | 328 | 118 | 248 | 335 |
| B | Absence | 238 | 466 | 680 | 271 | 559 | 859 | 256 | 486 | 832 |
| | Presence | 224 | 456 | 699 | 271 | 527 | 767 | 271 | 559 | 859 |
| C | Absence | 286 | 508 | 751 | 370 | 662 | 972 | 356 | 659 | 887 |
| | Presence | 304 | 533 | 755 | 352 | 578 | 930 | 370 | 662 | 972 |
| D | Absence | 230 | 417 | 660 | 265 | 495 | 708 | 252 | 540 | 737 |
| | Presence | 223 | 411 | 594 | 243 | 430 | 660 | 265 | 495 | 708 |

As can be seen in Table 1, the sleeve made of a non-magnetic material had little influence on a magnetic field generated by the magnetic field generating unit. That is, the sleeve made of a non-magnetic material could transmit a magnetic field to the molten metal in the sleeve without causing a reduction in the magnetic field strength or a deformation of the magnetic field generated by the magnetic field generating unit.

Figure 12:
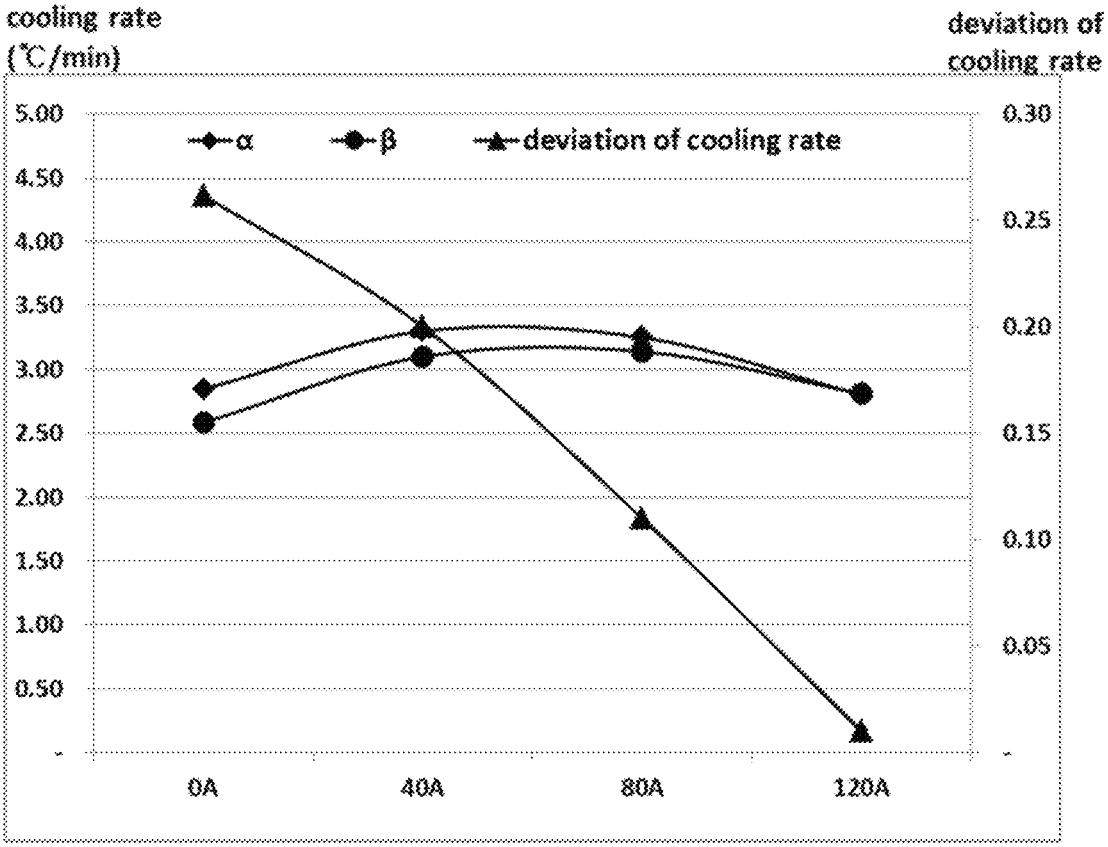
FIG. 12 is a graph illustrating a cooling rate of a molten metal as a function of a strength of an applied magnetic field and a deviation of the cooling rate.

Result 4—Cooling Rate Of Molten Metal As Function Of Strength Of Applied Magnetic Field FIG. 12 is a graph illustrating a cooling rate of a molten metal as a function of a strength of an applied magnetic field and a deviation of the cooling rate. In FIG. 12, the results of Experimental Example 8 are illustrated.

Referring to FIG. 12, as the strength of the magnetic field increased after the application of the magnetic field, the deviation of the cooling rate for each position of the molten metal decreased. This indicates that as the strength of the applied magnetic field increased, the distribution in temperature of the molten metal became more uniform.

The point α illustrated in FIG. 7 corresponds to (c) of FIG. 9, and the point β illustrated in FIG. 7 corresponds to (c) of FIG. 10. At these points, as illustrated FIGS. 9 and the magnetic field strength was in the range of 500 to 1000 Gauss. In addition, as illustrated in FIG. 12, the cooling rate was in the range of 2.8 to 3.3° C./min, and the deviation of the cooling rate was in the range of 0.01 to 0.12.

The peripheral regions of the points α and βillustrated in FIG. 7 correspond to (b) to (d) of FIGS. 9 and Therefore, referring to the description of Result 4 and FIGS. 9 and 10, when each pair of opposed electromagnets or each pair of non-adjacent electromagnets sequentially generates a magnetic field in the circumferential direction, a magnetic field in the range of 500 to 1000 Gauss was generated effectively at a relatively low current. In the case of the magnetic field in the range of 500 to 1000 Gauss, a current in the range of 80 to 120 A was applied.

From all the results, when each pair of opposed electromagnets or each pair of non-adjacent electromagnets sequentially generated the magnetic field in the circumferential direction, or the magnetic field in the range of 500 to 1000 Gauss was generated, or the current in the range of 80 to 120 A was applied, an effective magnetic field could be generated at a relatively low current, the distribution in temperature of the molten metal could become uniform, and vibrational stirring of the semi-solid molten metal could be effectively performed.

While the present disclosure has been described with reference to exemplary embodiments thereof, it will be understood by those skilled in the art that various changes and modifications may be made therein without departing from the technical idea and scope of the present disclosure and such changes and modifications belong to the claims of the present disclosure.

The invention claimed is:

1. A method of providing electromagnetic vibration stirring in a semi-solid high pressure casting equipment, comprising:

generating a magnetic field by using an electromagnetic vibration stirring device comprising a ring-shaped casing comprising an inner wall into which a sleeve is inserted and an outer wall spaced apart from the inner wall, and a magnetic field generating unit located between the inner wall and the outer wall of the casing, and comprising a plurality of electromagnets radially arranged at equal intervals around the sleeve in a circumferential direction of the sleeve, each of the electromagnets comprising a core and a coil surrounding the core, and applying, by using the magnetic field generating unit, a current for equal to or more than 0.5 seconds to each pair of opposed electromagnets or each pair of non-adjacent electromagnets sequentially in a clockwise or counterclockwise direction so that a portion of a semi-solid molten metal is sequentially vibrated in a vertical direction by the magnetic field along the circumferential direction of the sleeve, thereby controlling a microstructure of the molten metal by an intermittent vibrational flow in the vertical direction, wherein the magnetic field generating unit generates the current of 80 to 120 A, or the magnetic field of 500 to 1000 Gauss in a center region of the sleeve, and wherein a time period for applying the current to the entire electromagnets per one cycle is less than 20 seconds.

2. The method of claim 1, wherein the electromagnets of the magnetic field generating unit are arranged such that the respective cores of the electromagnets are located perpendicular to a central axis of the sleeve.

3. The method of claim 1, wherein the magnetic field generating unit comprises a cooling channel formed in the coil of each of the electromagnets.

4. The method of claim 1, wherein the respective cores of the electromagnets are radially arranged at equal intervals of 60 degree angles on an inner surface of the outer wall of the casing, and the respective coils of the electromagnets are coupled to the respective cores by insertion fitting.

5. The method of claim 1, wherein the sleeve is made of HK40 steel or ceramic.

6. The method of claim 1, wherein the electromagnetic vibration stirring device is located at a lower end or lower portion of a lower mold of the semi-solid high pressure casting equipment and is coupled to a lower portion of the sleeve.

* * * * *